United States Patent [19]

Blandford et al.

[11] Patent Number: 4,751,967

[45] Date of Patent: Jun. 21, 1988

[54] STAGE CEMENTING APPARATUS

[76] Inventors: David M. Blandford, 160 Sage Rd., Juniper Height, Durango, Colo. 81301; John H. Easter, 2418 Greenbriar, Abilene, Tex. 79605

[21] Appl. No.: 913,994

[22] Filed: Oct. 1, 1986

Related U.S. Application Data

[63] Continuation-in-part of Ser. No. 823,183, Jan. 27, 1986, Pat. No. 4,678,031.

[51] Int. Cl.[4] ..... E21B 33/14

[52] U.S. Cl. ..... 166/330; 166/289

[58] Field of Search ..... 166/285, 289, 330, 334; 251/343, 344, 345; 175/321

[56] References Cited

U.S. PATENT DOCUMENTS

| | | | |
|---|---|---|---|
| 1,404,353 | 1/1922 | Ellis | 166/242 |
| 2,407,983 | 9/1946 | Harper | 166/21 |
| 2,531,943 | 11/1950 | Lee | 166/330 X |
| 2,533,097 | 12/1950 | Dale | 285/199 |
| 2,624,549 | 1/1953 | Wallace | 255/28 |
| 2,900,028 | 8/1959 | Hanes | 166/242 |
| 2,972,471 | 2/1961 | McClintock et al. | 175/293 |
| 3,094,306 | 6/1963 | Conrad | 251/344 X |
| 3,098,667 | 7/1963 | Greenwood | 285/376 |
| 3,216,452 | 11/1965 | Williams | 166/289 X |
| 3,492,028 | 1/1970 | Seabourn | 285/45 |
| 3,764,168 | 10/1973 | Kisling III et al. | 285/302 |
| 3,910,349 | 10/1975 | Brown et al. | 166/153 |
| 4,105,069 | 8/1978 | Baker | 166/289 X |
| 4,105,074 | 8/1978 | Armstrong | 166/317 |
| 4,162,691 | 7/1979 | Perkins | 251/344 X |
| 4,312,405 | 1/1982 | Wilder | 166/285 |
| 4,326,586 | 4/1982 | Wilder | 166/285 |
| 4,333,530 | 6/1982 | Armstrong | 166/289 |
| 4,386,796 | 6/1983 | Lyall et al. | 285/31 |
| 4,487,263 | 12/1984 | Jani | 166/289 |
| 4,502,552 | 3/1985 | Martini | 175/56 |

FOREIGN PATENT DOCUMENTS

| | | |
|---|---|---|
| 226624 | 2/1960 | Australia . |
| 572750 | 2/1958 | Italy . |

*Primary Examiner*—Stephen J. Novosad
*Assistant Examiner*—David J. Bagnell
*Attorney, Agent, or Firm*—Richards, Harris, Medlock & Andrews

[57] ABSTRACT

A stage cementing apparatus (100) is disclosed which incorporates a stage cementing tool (102), a barrel (104) and a mandrel (106) for stage cementing of a casing within a wellbore. The apparatus (100) can be moved between a closed position preventing cement from flowing therethrough to the exterior of the casing at the apparatus to an open position to permit cement to flow from the interior of the casing exterior the casing to cement the casing to the wellbore. The barrel and mandrel can have cooperating splines which are engaged in a position which corresponds to the closed position of the apparatus. When the splines are disengaged, the apparatus is open to permit cement flow exterior the apparatus and concurrent rotation of the barrel relative to the mandrel to enhance the cementing of the casing within the wellbore.

10 Claims, 4 Drawing Sheets

STAGE CEMENTING APPARATUS

CROSS REFERENCE TO RELATED PPLICATIONS

This application is a continuation-in-part of U.S. patent application Ser. No. 823,183, filed Jan. 27, 1986, now U.S. Pat. No. 4,678,031 issued July 7, 1987.

TECHNICAL FIELD

This invention relates to cementing casings within a borehole, and in particular, to a stage cementing tool which can be used with a rotatable reciprocating stage collar for use during stage cementing operations.

BACKGROUND ART

After the drilling of a borehole into the earth has been completed for the purpose of exploration and/or testing for oil, gas, water and/or other minerals, a casing formed of pipe sections is usually run into the borehole and cemented in place. The casing helps to stabilize the different strata that have been penetrated by the borehole and keeps the borehole in a condition that allows testing tools, completion tools, production equipment and the like to be lowered into and retrieved from the borehole.

In order to isolate the different fluid producing strata from each other, and to stabilize and anchor the casing within the borehole, the casing is usually cemented into place. The cement provides a bond between the various strata which have been penetrated and the pipe within the borehole. With the varied strata having different properties and subsurface formation pressures, it is frequently necessary to provide coverage of all these zones with cement in order to isolate them from each other. In deeper wells, it is necessary, and has become standard operating procedure in many areas, to cement the casing in the borehole at different depths, as it may not be necessary nor economically feasible to cement the entire length of the casing within the borehole. Techniques of cementing the casing in the wellbore at various depths is commonly referred to as stage cementing. Typically, such multiple stage cementing processes allow cementing in separate stages, starting at the bottom of the borehole and progressing in stages up to the surface.

There are currently several types of stage cementing tools and apparatus on the market. For example, U.S. Pat. No. 4,333,530 to Armstrong shows a multistage cementing apparatus. In the typical process, multiple stage cementing is accomplished by the use of cementing tools, which are placed in the casing at one or more locations in the hole. In the first stage of the cementing operation, cement is pumped to the bottom of the casing and up the annulus to the lowest cementing tool in the well, or some lesser elevation as desired. In the next stage of the operation, the lower portion of the casing string is closed off and cement is pumped through a valve in the stage cementing tool into the annulus and up to the next cementing tool in the well, or some lesser height. Multiple stages of cementing are completed in this manner up to the surface of the well.

During primary cementing operations, it is desirable that the casing string be rotated and/or reciprocated to enhance cement bonding between the casing and the borehole wall. If the casing is not rotated and/or reciprocated while the cement is being forced into the annulus, poor bonding is likely to result. During the first stage of cementing, the entire casing string can be rotated and/or reciprocated while the cement is pumped into the annulus. However, after the first stage of cementing is complete and the casing string is fixed in place, further rotation and/or reciprocation of the casing string generally becomes impossible.

A need exists for an improved stage cementing tool which renders the process of multiple stage cementing more efficient and effective. A need particularly exists to achieve the advantages of casing string rotation and/or reciprocation of the individual segment being cemented to insure the most effective bond between the segment and the borehole.

SUMMARY OF THE INVENTION

In accordance with one aspect of the present invention, a stage cementing apparatus is disclosed which provides for stage cementing while permitting rotatable reciprocating movement of the casing string being cemented. The apparatus includes a combined rotatable reciprocating collar and a stage cementing tool which enhances cement bonding by allowing rotation and/or reciprocation of the upper portion of the casing string after the lower portion of the string has been cemented in place. The apparatus remains downhole as an integral part of the casing string after the stage cementing operation has been completed.

In accordance with another aspect of the present invention, the apparatus of the present invention can include a cylindrical barrel assembly, which is connected to one segment of the casing, and a cylindrical mandrel, which is connected to the other segment of the casing and which reciprocates telescopically within the barrel assembly. The mandrel has a plurality of splines projecting radially outward from the end of the mandrel disposed within the barrel assembly. The barrel assembly has a corresponding plurality of splines projecting radially inward from its inner surface. The splines of the mandrel engage the splines of the barrel assembly when the mandrel is telescopically extended. The barrel assembly includes a stop for contacting the mandrel splines to prevent the mandrel from extending beyond a predetermined limit and separating from the barrel assembly. When the splines of the mandrel and the barrel assembly are engaged, the entire casing string, joined by the collar, can be rotated as a unit. The casing string and the apparatus are kept in tension while placing the casing down the borehole and during all cementing operations at lower stages so that the mandrel remains extended, the mandrel and barrel assembly splines remain engaged, and the entire casing string remains rotatable only as a unit.

To perform the function of the stage cementing tool, the barrel assembly has an annular groove formed into its inner surface which communicates to the exterior of the barrel through a series of ports. At least one slot is formed through the mandrel at a first position along the length of the mandrel. When the barrel assembly and mandrel are telescopically extended with their splines engaged, O ring seals between the mandrel and barrel prevent fluid communication between the slots in the mandrel and the annular groove in the barrel to prevent cement outflow from the interior of the string at the position of the apparatus. However, when the mandrel telescopes into the barrel assembly to disengage the splines, permitting relative rotation therebetween, the slots in the mandrel align with the annular groove in the barrel assembly so that cement within the string passes through the slot, to the annular groove and through the exterior ports of the stage tool and to the annulus between the exterior of the apparatus and the wall of the borehole for cementing. As the cement is being pumped into this annulus, the section of casing being cemented can be rotated and reciprocated to form an effective bond.

In accordance with yet another aspect of the present invention, the stage cementing tool can be employed without splines. Thus, rotational motion cannot be transferred between the cylindrical barrel assembly and the cylindrical mandrel. However, the barrel assembly and mandrel can be moved from a position with the slots in the mandrel and the annular groove in the barrel isolated to a position where they are aligned so that cement can pass through the slots, to the annular groove and through the exterior ports of the stage tool to the wall of the borehole for cementing.

In accordance with another aspect of the present invention, the apparatus can comprise a cementing tool which is threadedly engaged to the spline carrying portion of the barrel. In accordance with another feature, the apparatus does not require drilling out of plugs or other metal materials before access to lower portions of the casing below the apparatus can be achieved.

BRIEF DESCRIPTION OF THE DRAWINGS

For a more complete understanding of the present invention and for further advantages thereof, reference is now made to the following description of the preferred embodiment taken in conjunction with the accompanying drawings, in which.

DETAILED DESCRIPTION

The following description of the device illustrated in FIGS. 1-4 is from the parent patent application Ser. No. 823,183, filed Jan. 27, 1986. This description is included herein to set forth significant details and features of the rotatable reciprocating collar which can be incorporated in the present invention.

Figure 1:
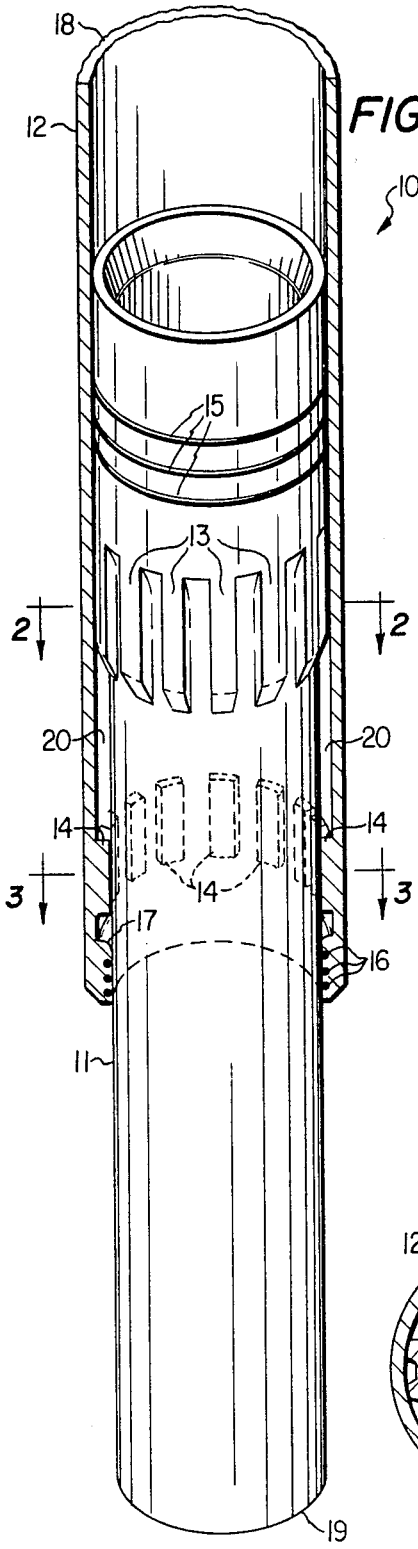
FIG. 1 is a cutaway perspective view of a device disclosed in the parent application showing a barrel and mandrel positioned with their splines disengaged.

Referring to FIG. 1, reference numeral 10 generally identifies a rotatable reciprocating collar. Collar 10 includes a barrel 12 and a mandrel 11. Barrel 12 is an open ended cylinder which attaches at end 18 to one segment of a well borehole casing pipe string. Mandrel 11 is an open ended cylinder telescopically inserted into barrel 12. Mandrel 11 is connected at end 19 to the other segment of the casing pipe string.

Mandrel 11 includes a plurality of mandrel splines 13 projecting radially outward from the end of mandrel 11 inserted into barrel 12. The splines 13 of mandrel 11 are more clearly illustrated in the cross-sectional diagram of FIG. 2. Barrel 12 includes a corresponding plurality of barrel splines 14 projecting radially inward from the end of barrel 12 remote from the end 18 connected to the casing string. Splines 14 of barrel 12 are more clearly illustrated in the cross-sectional diagram of FIG. 3.

Mandrel 11 includes O-ring seals 15, and barrel 12 includes O-ring seals 16. O-ring seals 15 and 16 maintain a seal between the interior and exterior of collar 10 as mandrel 11 rotates and/or reciprocates longitudinally with respect to barrel 12.

O-ring seals 15 and 16 provide an additional advantage during use of collar 10. When collar 10 is formed by inserting mandrel 11 into barrel 12, the O-ring seals 15 and 16 form an air-tight seal. Thus, when collar 10 is fully extended, the air space 20 between seals 15 and 16 is compressed to as much as 3,000 p.s.i. This air pressure does not leak off. During use of collar 10, the air pressure assists in retracting mandrel 11 into barrel 12, thus relieving part of the load on the associated oilwell machinery.

During placement of the casing string into the borehole and during all cementing operations occurring below the level of the collar 10, the casing string is under tension so that mandrel 11 is fully extended with respect to barrel 12. Barrel 12 includes a stop 17 for contacting mandrel splines 13 to limit the extension of mandrel 11 and prevent it from separating from barrel 12 while the collar 10 is under tension. In the fully extended position, splines 13 of mandrel 11 engage splines 14 of barrel 12 so that the upper and lower casing strings can be rotated only as a unit.

Figure 4:
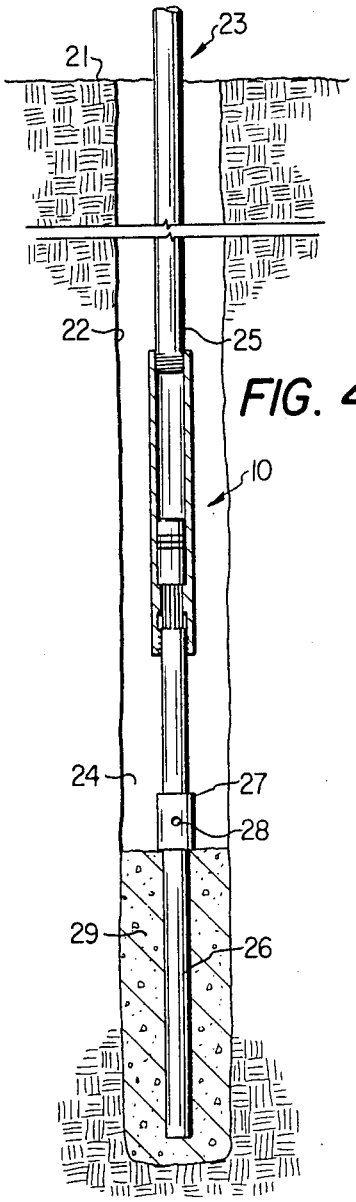
FIG. 4 is a longitudinal sectional diagram of a wellbore hole illustrating the use of the device of FIG. 1 within a casing pipe string.
Figure 2:
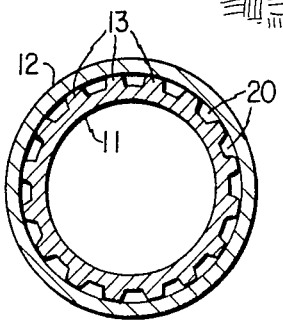
FIG. 2 is a cross sectional diagram of the device of FIG. 1 taken along section 2—2 of FIG. 1.
Figure 3:
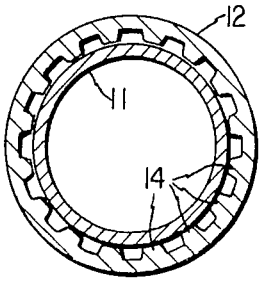
FIG. 3 is a cross sectional diagram of the device shown in FIG. 1 taken at section 3—3 of FIG. 1.

As illustrated in FIG. 4, during the first stage of a multistage cementing operation cement 29 is forced out the bottom of the casing pipe 23 and into the annulus 24 between the borehole 22 and the casing pipe 23 up to the level of the lowest stage cementing tool 27 in the casing pipe 23. Normally, collar 10 is positioned immediately above or below the cementing tool 27 in the casing string. After the, first stage of cementing is complete and cement 29 has set, the lower segment 26 of the casing string is fixed within the borehole 22 by cement 29. At this point in the cementing operation, cement 29 supports the weight of the lower segment 26, including mandrel 11 which is rigidly attached to lower segment 26 at end 19, thus allowing the upper segment 25 of the casing string to be lowered with respect to the lower segment 26. Barrel 12, which is rigidly attached to the upper segment 25 at and 18, is lowered with respect to mandrel 11 a distance greater than the engaging length of splines 13 and 14 so that mandrel 11 telescopes into barrel 12 and splines 13 and 14 become disengaged.

In the next stage of the cementing operation, the lower segment 26 of the casing is blocked and cement is forced through a valve port 28 in the cementing tool 27 and into the annulus 24 around the upper segment 25 of the casing string. As long as the splines 13 and 14 of collar 10 remain disengaged, during this stage of cementing, the upper segment 25 of the casing string may be reciprocated and/or rotated with respect to the lower segment 26 of the casing string, which is fixed in place by hardened cement 29. Before the upper stage cement is allowed to set, splines 13 and 14 of collar 10 are normally reengaged by providing tension to the upper segment 25 of the casing string so that mandrel 11 and barrel 12 are telescoped to their fully extended length. Thus, collar 10 remains an integral part of the casing string after cementing has been completed up to the surface 21 of the well borehole 22.

The rotatable reciprocating collar 10 can be oriented with either the barrel 12 uppermost and attached to the upper segment 25 or with the barrel 12 lowermost and attached to the lower segment 26, but collar 10 is normally oriented with the barrel in the uppermost position shown in FIG. 1. The collar 10 can be manufactured in any size to accommodate any diameter casing used in the borehole. A casing adapter may be provided for either or both the mandrel and the barrel to facilitate connection to the casing pipe or the cementing tool 27. The collar 10 is also designed to be used with any presently available cementing tool. Further, the length of the barrel 12 and the mandrel 11 can be made sufficiently long to allow for adequate longitudinal reciprocation of the mandrel 11 with respect to the barrel 12 to enhance cement bonding between the casing string and the borehole wall.

With reference now to FIGS. 5–8, a stage cementing apparatus 100 is disclosed which incorporates a stage cementing tool 102 which can be used in place of conventional stage cementing devices and in combination with the rotatable reciprocating collar as originally disclosed in FIGS. 1–4 and as shown in modified form in FIGS. 5–8 to incorporate the tool 102. The modified rotatable reciprocating collar incorporates a barrel 104 and a mandrel 106 telescopically received therein.

As in the collar of FIGS. 1–4, the barrel 104 is connected to the upper portion of the casing string which eventually extends to the surface. The mandrel 106 is connected to the lower portion of the casing string which extends to the bottom of the wellbore. The barrel 104 and mandrel 106 have cooperating splines 108 and 110 and the barrel and mandrel are designed to provide rotatable reciprocating motion between the lower portion 111 and upper portion 113 of the string 112 in the same manner as barrel 12 and mandrel 11 described above.

Figure 5:
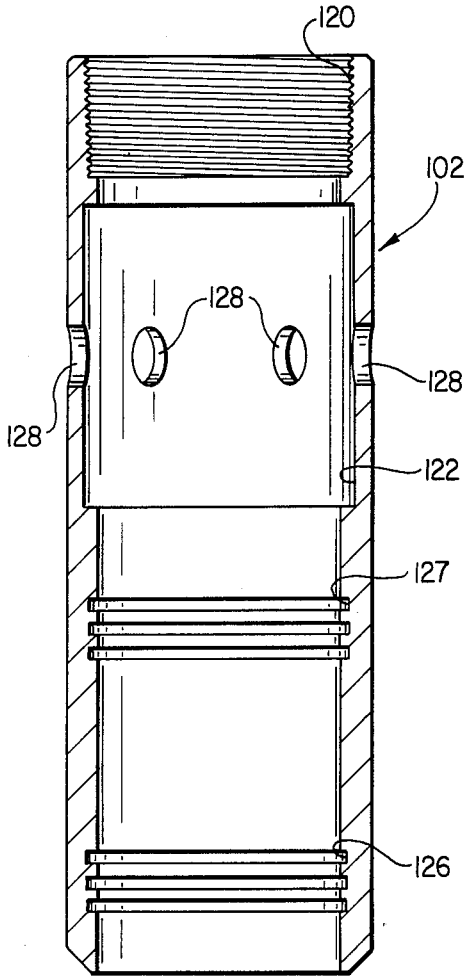
FIG. 5 is a cross sectional view of a stage cementing tool forming one embodiment of the present invention.

The barrel 104 ends in a decreased diameter threaded portion 118 to which the stage cementing tool 102 is threadedly secured. As best seen in FIG. 5, the stage cementing tool 102 has a generally cylindrical configuration with an inset threaded portion 120 to engage threaded portion 118 of the barrel 104. Spaced along the tool 102 is an annular groove 122 which extends radially outwardly from the interior surface of the tool. The groove 122 extends continuously about the entire inner circumference of the tool. Ports 128 extend from the groove through the tool to the exterior of the tool Two sets of O-ring grooves 126 and 127 are cut into the interior surface of the tool at spaced locations on the side of groove 122 opposite the threaded portion 120. The O-ring grooves are adapted to accept O-rings 132 to form an annular seal between the inner surface of the tool 102 and the outer surface of the mandrel 106. A third set of O-ring grooves 130 is formed into the interior surface of the barrel 104 proximate the theaded portion 118 to receive O-rings 132 to form a seal between the inner surface of the barrel 104 and the outer surface of the mandrel 106.

The mandrel 106 is substantially identical to the mandrel 11 described previously, with the exception of the slots 134 formed through the mandrel about the circumference of the mandrel at a selected position along the length of the mandrel. While the slots 134 are shown as rectangles, they can as readily be circular or any other shape.

Figure 6:
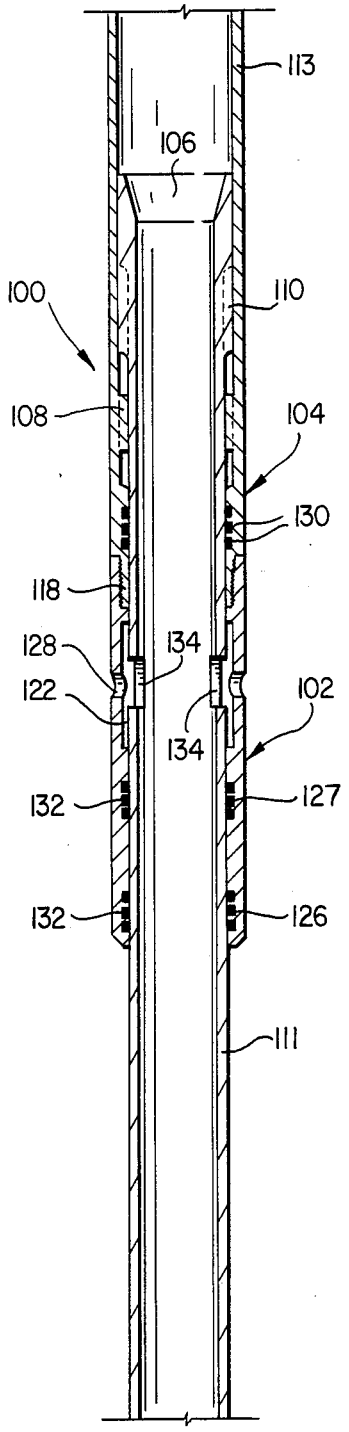
FIG. 6 is a cross sectional view of a stage cementing apparatus forming a first embodiment of the present invention in the open position whereby cement within the string can be extruded into the annulus between the apparatus and wellbore to cement a portion of the string within the wellbore.

As can be seen in FIG. 6, when the mandrel 106 is retracted into the barrel 104 so that the splines 108 and 110 are disengaged, at least a portion of the slots 134 will open into the annular groove 122. Thus, pressurized cement within the interior of the casing will be permitted to flow out through slots 134 into groove 122 and exterior of the casing through the ports 128. The relative orientation of the mandrel with respect to the barrel about the elongate axis of the casing will be irrelevant to the flow as the annular groove 122 extends in a continuous manner around the entire inner periphery so that if the mandrel is in the proper position relative to the barrel along the elongate axis of the casing such that slots 134 open into the annular groove 122, the flow to the exterior of the casing will be unimpeded.

Figure 7:
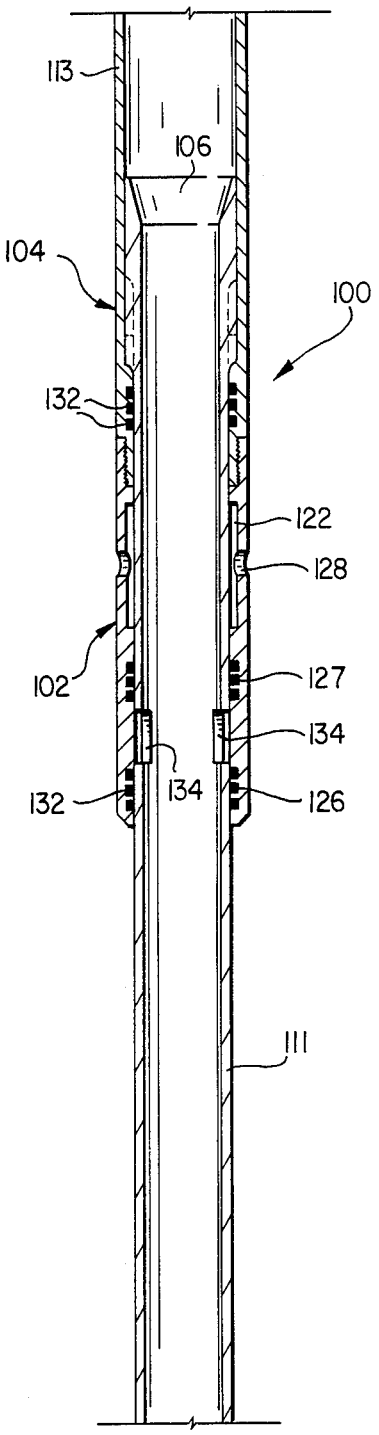
FIG. 7 is a cross sectional view of the stage cementing apparatus shown in the closed position for preventing cement from passing within the string to the annulus about the apparatus.
Figure 8:
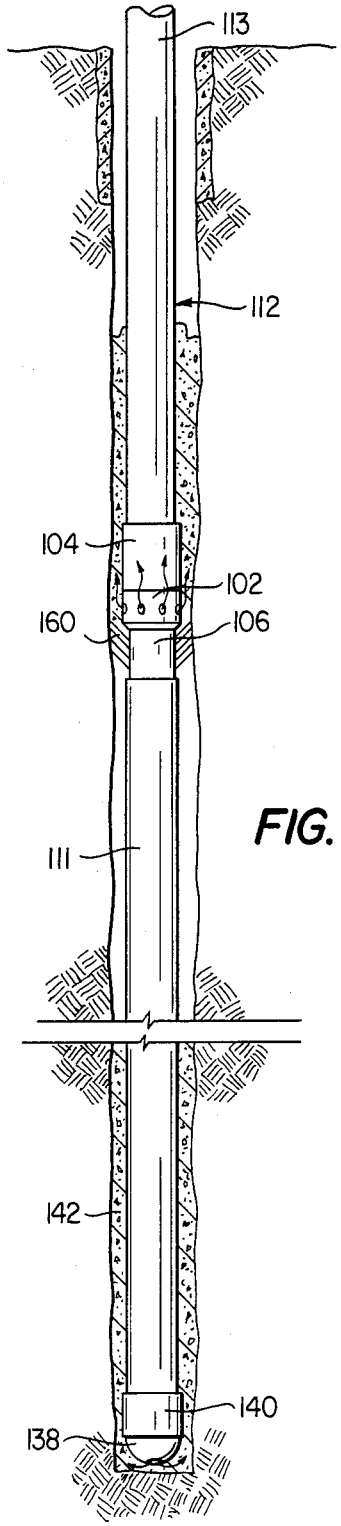
FIG. 8 is a diagrammatic view illustrating the use of the stage cementing apparatus within a wellbore.

With reference to FIG. 7, when the barrel 104 and mandrel 106 are in the extended position relative to each other, with the splines 108 and 110 engaged, the slots 134 are moved along the length of the casing so that they are no longer in communication with the groove 122. The O-rings 132 in the first set of O-ring grooves 126 will prevent cement from passing through the slots 134 about the end of the tool 102. The O-rings 132 in the second set of O-ring grooves 127 will prevent cement from flowing through the slots 134 along any annular gap between the mandrel 106 and the tool 102 to the groove 122. The O-rings 132 in the third set of O-ring grooves 130 will prevent flow of cement from the interior of the casing past the engaged splines to the groove 122. The O-rings and grooves described above also prohibit backflow of pump cement or fluid from the casing borehole annulus back into the interior of the casing string. With reference now to FIG. 8, the method of operation will be described. The casing 112 illustrated is a two stage cementing system. Cement is initially pumped down the interior of the casing to the bottom of the borehole and enters the borehole through holes in the guide shoe 138. The cement flows over the float collar 140 and up the annular space 142 between the lower portion 111 of the casing 12 and the wall of the borehole to a desired height. During this initial stage, the barrel 104 and mandrel 106 are extended to close the apparatus 100 and prevent cement from passing through the apparatus exterior of the string. The engagement of the splines 108 and 110 also permit rotation and reciprocation of the lower portion 111 as the cement fills the annular space 142 to provide an effective cementing within the borehole.

For the second stage cementing, the upper portion 113 is lowered relative to the now fixed lower portion 111 to disengage the splines 108 and 110 and open the apparatus 100 so that the slots 134 open into the annular groove 122. A drillable plug can be used to close off the passage through the lower portion and cement is then pumped down through the casing and out through the apparatus 100 to a second predetermined height, as seen in FIG. 8. If the first cement stage does not provide cement up to the apparatus 100, an annular packing 160 can be provided so that cement flowing through the apparatus 100 moves generally upward. This would be used when an extremely long string is present and continuous cementing of the string is not necessary. As the cement is being pumped during the second cement stage, the upper portion 113 can be rotated relative to the lower portion 111 to provide more effective bonding. To a limited extent, the upper portion 113 can be reciprocated vertically relative to the lower portion 111, although if the portions are extended too far, the slots 134 will close off from the annular groove 122. After the second stage cement has been pumped and displaced to the desired height, the barrel is raised to its extended position to close apparatus 100 to complete the cementing process.

It is clear that additional cement stages can be employed by simply using more stage cementing apparatus 100 along the length of the string 112. Preferably, the upper portion 113 will be lifted vertically upward to provide a tension in the apparatus 100 which is maintained by the set cement.

In one apparatus constructed in accordance with the teachings of the present invention, four slots 134 were formed through the mandrel 106 at symmetrical 90° angles from each other about the circumference of the mandrel. The slots were an inch long parallel the length of the string 112 and one half inch wide. The ports 128 connecting groove 122 to the exterior of the tool 102 had a $\frac{7}{8}$" diameter.

To open the stage cementing apparatus 100, the following steps can be taken. Prior to cementing, the weight of the casing string is measured by a weight indicator as it hangs from a support on the surface. This will show how much the casing actually weighs or what the hook load is at the surface. The weight of the lower portion cemented in the borehole during the first cementing stage is deducted from this weight to give the weight of the remainder of the casing string from the first stage cementing apparatus 100 to the surface. The upper portions of the string can then be lowered by the distance necessary to move the apparatus 100 to the open position. After the second stage of cementing is completed, the portion can be lifted to close apparatus 100. Once lifted, the casing can be set in slips at the surface to set the casing in tension. This tension is, as previously mentioned, maintained as the cement sets, with the barrel splines and mandrel splines thereafter being forever engaged and keeping the apparatus 100 closed to isolate the annulus about the string from the interior of the string.

A significant advantage of the present design is the absence of any necessity to drill out metal parts or plugs to open up the interior of the string below the respective stage tool or tools. This advantage is achieved because the interior diameter of the mandrel 106 is designed to be no less than the interior diameter of the casing, saving a great deal of time and effort previously needed for drilling through a cementing portion.

At times, operators may not wish to rotate the casing string for various reasons. For example, borehole conditions may not allow such movement during cementing operations. When the casing is not rotated, the cementing operation simply involves running the casing into the hole to the desired depth. The lower portion of the casing string is cemented as it sits in a static position. The use of stage cementing tools along the length of the casing string can then permit cementing along the length thereof to the surface. After the casing is initially set, the stage cementing tools can be sequentially opened from the bottom up to allow cementing at each tool without any rotary string movement at all.

Figure 9:
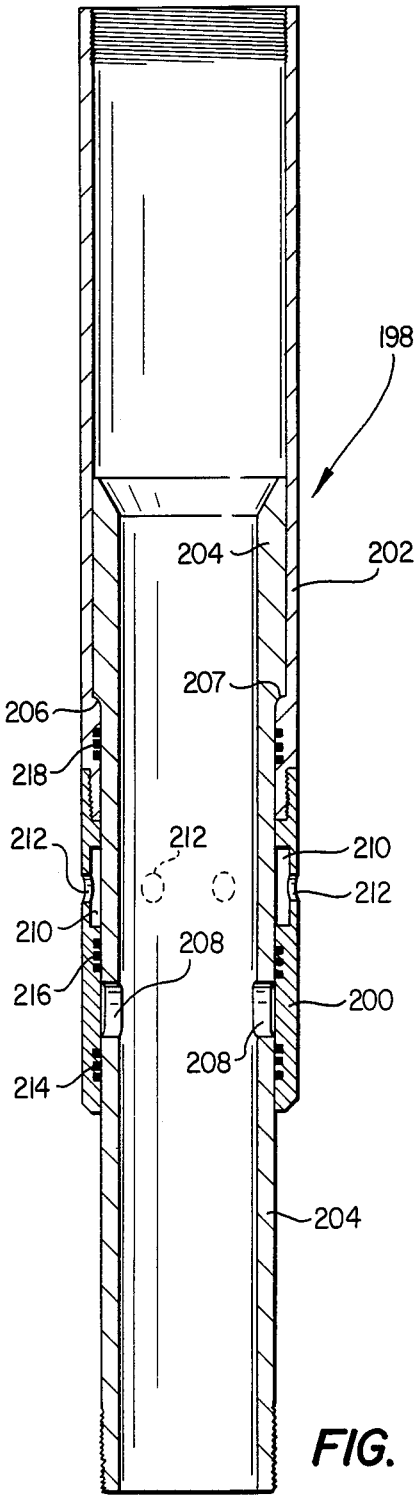
FIG. 9 illustrates a rotating stage collar and cementing tool assembly in a closed position without a spline drive mechanism.
Figure 10:
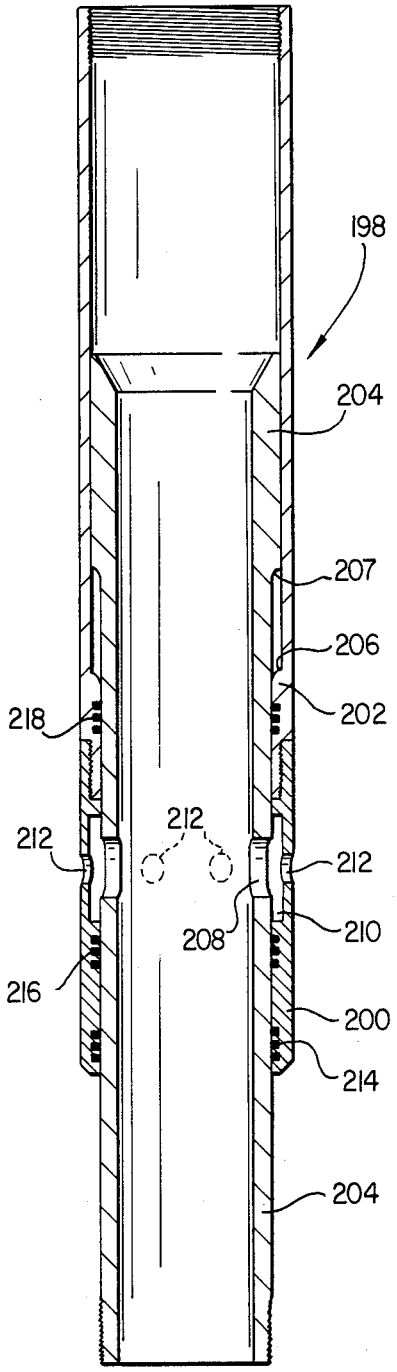
FIG. 10 illustrates the rotating stage collar and stage cementing tool assembly of FIG. 9 in the open position.

The modified stage cementing apparatus 198, illustrated in FIGS. 9 and 10, forms an effective device for such operations where casing movement is undesirable or impractical. Stage cementing tool 200 is similar in design and function to stage cementing tool 102. Barrel 202 and mandrel 204 are similar to barrel 104 and mandrel 106 with the exception that no splines 108 and 110 are provided in barrel 202 and mandrel 204. By eliminating the splines, the cost of the apparatus is significantly reduced. In addition, the exclusion of the spline rotating system only prohibits rotation of the portion of the casing string downhole from the tool 200. The casing string above the apparatus 198 can still be rotated from the surface. Therefore, an operator could position an apparatus 198 along a casing string and an apparatus 100 along a casing string above the apparatus 198. The operator would only be prevented from rotating the portion of the casing string below the apparatus 198.

FIG. 9 illustrates apparatus 198 in the running in the borehole or closed position. The outer barrel 202 is secured at the bottom of the upper portion of the casing string. Mandrel 204 is secured on the lower portion of the casing string and extends into the interior of the outer barrel 202. Cooperating annular stops 206 and 207 on the barrel 202 and mandrel 204, respectively, limit the outward telescoping motion of mandrel 204. In this closed position, the slots 208 through the wall of the mandrel 204 are isolated from the annular groove 210 and ports 212 through the barrel 202 by a series of O-ring seal sets 214, 216 and 218. The closed position is maintained when the casing string is in tension as when the weight of the lower portion of the casing string keeps the entire casing string in tension to engage the stops 206 and 207. While O-ring seal sets 214, 216 and 218 are disclosed, other types of seals can be used, such as lip seals.

The first stage of cementing will be conducted with apparatus 198 in the closed position as seen in FIG. 9. The cement thus passes down the annular bore of the casing string to the bottom of the casing string to cement the bottom in the borehole. After the first stage cementing operation is complete, the apparatus 198 is moved to the opened position as depicted in FIG. 10 by simply lowering the upper portion of the casing string relative to the lower portion of the casing string so that the mandrel 204 telescopes into the outer barrel 202. In the absence of spline structure, only sufficient movement vertically is required such that the slots 208 line up with groove 210. Thereby, the interior portion of the casing string communicates to the exterior of the casing string at tool 200. Thus, fluid and/or cement can be circulated through the tool 200 and cementing operations can proceed. If the operator desires to rotate the upper portion of the casing string, such rotation can occur. When the cementing operation is complete, the operator simply moves the upper portion of the casing string vertically until the stops 206 and 207 are again engaged and the apparatus 198 is again in a closed position.

Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. A stage cementing apparatus for selectively passing cement from the interior passage of a casing to the annulus between the exterior of the casing and borehole, the casing having an upper portion and a lower portion, said apparatus comprising:

a barrel secured to the upper portion of the casing;

a mandrel secured to the lower portion of the casing, said mandrel telescoped within the barrel for vertical movement of the upper portion relative the lower portion, said mandrel having at least one aperture opening through the wall of the mandrel;

a stage cementing tool having a generally cylindrical configuration adapted for attachment to the lower end of the barrel about a portion of the mandrel, said stage cementing tool having an annular groove formed into the inner wall thereof about the entire circumference of the tool for alignment with the aperture in the mandrel when said mandrel and barrel are moved to a first predetermined relative position to pass cement from within the casing to the annulus outside the casing at the stage cementing tool, the barrel and stage cementing tool being free for unrestricted rotation about the mandrel in the first predetermined relative position without interrupting the passing of cement from within the casing to the annulus outside the casing, the stage cementing apparatus thereby permitting rotation of the upper portion relative to the lower portion during a multi-stage cementing operation subsequent to cementing the lower portion in place to enhance the cementing of the upper portion within the borehole, said apparatus being permanently cemented within the borehole.

2. The apparatus of claim 1 wherein the upper portion can be rotated relative to the lower portion about the elongate axis of the casing, the continuous annular groove providing for flow of cement from the interior of the casing to the exterior of the casing as the upper portion rotates relative the lower portion in the first relative position.

3. The apparatus of claim 1 wherein said barrel is movable relative to said mandrel to a second relative position to close the tool to prevent cement flow from the interior of the casing to the exterior of the casing through the tool, seal means being provided between said stage cementing tool and the mandrel to isolate the apertures from the annular groove.

4. A stage cementing apparatus for use in stage cementing a casing within a borehole, the casing having an upper portion and a lower portion, comprising:

an open cylinder barrel assembly having an inner surface and an annular groove formed into the inner surface about the entire inner circumference of the inner surface at a selected location along the length of the barrel assembly;

a plurality of barrel splines projecting radially inward from said inner surface at one end of said barrel assembly;

an open cylindrical mandrel having an outer surface, one end of said mandrel telescopically positioned within the end of said barrel assembly having said barrel splines, said mandrel having at least one slot formed through the wall of the mandrel at a preselected location along the length of the mandrel;

a plurality of mandrel splines projecting radially outward from said outer surface at the end telescopically positioned within said barrel assembly for engaging said barrel splines, the barrel assembly being movable relative the mandrel so that when said splines are engaged, the slot in the mandrel is isolated from the annular groove in the barrel assembly, and when said splines are disengaged, the slot in the mandrel opens into the groove in the barrel assembly to permit fluid to flow from within the casing outside the apparatus; and said mandrel splines engaging said barrel splines when said casing is being cemented below said apparatus to permit simultaneous rotation and reciprocation of both upper and lower portions of the casing, said mandrel splines disengaging said barrel splines when cement is passed through said annular groove and slot for passing cement between the interior of the casing and the annulus proximate the apparatus subsequent to cementing of the lower portion within the borehole to permit independent reciprocation and rotation of the upper portion relative to the lower portion to enhance the cementing of the upper portion within the borehole, said apparatus being permanently cemented within the borehole.

5. The apparatus of claim 4 wherein said barrel assembly comprises a barrel having a threaded end and a stage cementing tool threaded onto the threaded end of the barrel, the annular groove being formed into the inner surface of the stage cementing tool.

6. The apparatus of claim 4 wherein the inner diameter of the mandrel is at least as great as the internal diameter of the upper and lower portions of the casing to eliminate any cutting to open the interior of the lower portion after cementing.

7. The apparatus of claim 4 wherein first and second sets of O-ring grooves are formed into the inner surface of said barrel assembly to receive O-rings to seal between said barrel assembly and said mandrel to isolate the slot through the mandrel from the exterior of the casing.

8. A stage cementing apparatus for stage cementing along the length of a casing within a borehole between an upper portion of the casing and a lower portion of the casing, comprising:

an open cylindrical barrel having an inner surface secured at a first end thereof to the lower end of the upper portion of the casing, the opposite end of the barrel being threaded;

a stage cementing tool having a cylindrical configuration and defining an inner surface of equal radius to the inner surface of the barrel and a groove in the inner surface, the upper end of said stage cementing tool having a threaded portion to threadedly engage the threaded end on the barrel;

a plurality of barrel spines projecting radially inward from the inner surface of the barrel;

an open cylindrical mandrel having an outer surface and at least one slot therethrough, the lower end of the mandrel being secured to the lower portion of the casing and the upper end of the mandreal telescopically received within said stage cementing tool and extending into the barrel;

a plurality of mandrel splines projecting radially outward from the outer surface of the mandrel within said barrel for engaging said barrel splines;

the mandrel and barrel being moved to a first relative position with said splines engaged and the apparatus closed to prevent flow of cement from within the casing to exterior the casing at the aparatus by positioning the slot in the mandrel away from the groove in the stage cementing tool, said barrel and mandrel movable to a second relative position with the splines disengaged to permit relative rotation therebetween, the slot opening into the groove to provide a path for cement of flow from the interior of the casing to exterior the casing of the apparatus for cementing the casing within the borehole; and said mandrel splines engaging said barrel splines when cementing the lower portion within the borehole to permit simultaneous rotation and reciprocation of the entire casing, and said mandrel splines being disengaged from said barrel splines when cement passes through the groove and slot for cementing the upper portion within the borehole subsequent to cementing of the lower portion therein, thereby permitting the upper portion to be reciprocated and rotated to facilitate the cementing operation independent of the lower portion.

9. The apparatus of claim 8 further having first and second sets of O-ring grooves formed in the inner surface of the stage cementing tool to receive O-rings to form an annular seal between the stage cementing tool and the mandrel on either side of the slot when the mandrel and barrel are in the first relative position.

10. The apparatus of claim 8 wherein the internal diameter of the mandrel is at least as great as the internal diameter of the remainder of the casing to avoid the necessity for drilling through the mandrel to open up the lower portion of the casing after cementing.

* * * * *